US011053039B2

(12) United States Patent
Sander et al.

(10) Patent No.: US 11,053,039 B2
(45) Date of Patent: Jul. 6, 2021

(54) PROCESSING DEVICE FOR FOIL POUCHES

(71) Applicant: INDAG Pouch Partners GmbH, Eppelheim (DE)

(72) Inventors: Jörg Sander, Heidelberg (DE); Ralf Sander, Heidelberg (DE); Josef Weis, Nußloch (DE)

(73) Assignee: INDAG POUCH PARTNERS GMBH, Eppelheim (DE)

( * ) Notice: Subject to any disclaimer, the term of this patent is extended or adjusted under 35 U.S.C. 154(b) by 169 days.

(21) Appl. No.: 15/583,214

(22) Filed: May 1, 2017

(65) Prior Publication Data

US 2017/0313455 A1 Nov. 2, 2017

(30) Foreign Application Priority Data

May 2, 2016 (EP) ..... 16167899

(51) Int. Cl.

| | |
|---|---|
| ***B65B 43/28*** | (2006.01) |
| ***B65B 43/12*** | (2006.01) |
| ***B65B 43/44*** | (2006.01) |
| ***B65B 59/00*** | (2006.01) |
| ***B65B 43/26*** | (2006.01) |
| ***B65B 3/04*** | (2006.01) |
| ***B65B 43/46*** | (2006.01) |

(52) U.S. Cl.

CPC ..... *B65B 43/28* (2013.01); *B65B 3/04* (2013.01); *B65B 43/12* (2013.01); *B65B 43/26* (2013.01); *B65B 43/44* (2013.01); *B65B 43/465* (2013.01); *B65B 59/003* (2019.05); *B65B 59/005* (2013.01)

(58) Field of Classification Search

CPC ..... B65B 43/28; B65B 43/12; B65B 43/465; B65B 43/26; B65B 43/44; B65B 43/04; B65B 43/30; B65B 59/005; B65B 3/04; B65B 65/02; B65G 17/26; B65G 19/02

USPC ..... 53/381.1, 384.1, 468, 570; 198/379

See application file for complete search history.

(56) References Cited

U.S. PATENT DOCUMENTS 4,108,300 A * 8/1978 Hayase ..... B65B 43/26 198/470.1
4,263,768 A * 4/1981 Russell ..... B65B 43/465 198/803.4
4,509,313 A * 4/1985 Koppe ..... B65B 1/02 53/570

(Continued)

OTHER PUBLICATIONS

EP16167899.0; European Search Report; dated Dec. 6, 2016, pp. 1-7.

(Continued)

*Primary Examiner* — Thomas M Wittenschlaeger
(74) *Attorney, Agent, or Firm* — Mayer Brown LLP

(57) ABSTRACT

The invention relates to a processing device for foil pouches, comprising a plurality of pouch receiving elements arranged side by side, each of them being configured to receive and transport one foil pouch, a plurality of pairs of oppositely disposed ramps arranged successively in the direction of transport, the pouch receiving elements being transported in a guided manner along said ramps when in operation, the distance of oppositely disposed ramps defining the width of the pouch receiving elements, and an adjusting element configured to automatically adjust the distance transversely to the direction of transport between oppositely disposed ramps.

14 Claims, 6 Drawing Sheets

(56) References Cited

U.S. PATENT DOCUMENTS 4,519,185 A * 5/1985 Horn ..... B65B 9/06 493/302
4,956,964 A * 9/1990 Jones ..... B65B 9/087 198/803.9
4,982,552 A * 1/1991 Odenthal ..... B65B 11/004 53/207
4,986,056 A * 1/1991 Evans ..... B65B 59/005 53/247
5,058,364 A * 10/1991 Seiden ..... B65B 43/04 53/385.1
5,072,573 A * 12/1991 Tisma ..... B65B 35/205 198/803.9
5,222,535 A 6/1993 Roders
6,050,061 A * 4/2000 Todd ..... B65B 43/465 53/201
6,073,424 A * 6/2000 Kraft ..... B65B 43/465 53/570
6,536,102 B1 * 3/2003 Heuterman ..... B65B 61/14 29/453
7,216,758 B2 * 5/2007 Hartness ..... B65G 17/323 198/468.2
8,122,684 B2 * 2/2012 Kurz ..... B65B 59/005 53/284.7
8,468,783 B2 * 6/2013 Uebler ..... B65B 43/28 493/309
8,707,663 B2 * 4/2014 Matheyka ..... B65B 43/465 141/166
10,351,281 B2 * 7/2019 Garriga Jimenez .... B65B 61/06
10,450,095 B2 * 10/2019 Brandhorst ..... B65B 13/20
2007/0241151 A1 * 10/2007 Murray ..... B65B 43/465 224/407
2009/0158694 A1 * 6/2009 Matheyka ..... B65B 43/465 53/468
2010/0269458 A1 * 10/2010 Veix ..... B65B 43/465 53/570
2012/0210675 A1 * 8/2012 Murray ..... B65B 31/042 53/403
2014/0318712 A1 * 10/2014 Stuhlmann ..... B65G 47/08 156/556
2014/0332352 A1 * 11/2014 Ishikawa ..... B65G 47/842 198/803.7
2015/0135650 A1 * 5/2015 Lau ..... B65B 9/04 53/453
2019/0225359 A1 * 7/2019 Spindler ..... B65B 59/02
2020/0002071 A1 * 1/2020 Anklam ..... B65B 25/146

OTHER PUBLICATIONS

English translation of the Search Report received in EP 16167899 and dated Dec. 6, 2016.
English-machine translation of EP 2113462 A1.
English-machine translation of DE 2622291A1.
English-machine translation of DE102006028796 A1.

* cited by examiner

PROCESSING DEVICE FOR FOIL POUCHES

RELATED APPLICATIONS

This application claims the benefit of, and priority to, European Patent Application No. 16167899.0, filed May 2, 2016, which is incorporated by reference herein in its entirety.

BACKGROUND

For a processing device for foil pouches or bags, for instance a filling machine, it is determined by the process that the degree of opening of the foil pouches along the transport route is changed. For instance, while being supplied to the pouch receiving element foil pouches are flat and of maximum width. However, to obtain an optimum filling, the foil pouches are expected to have the largest possible opening during the dosing process. The differences concerning the degree of opening will be adjusted by means of the ramps provided laterally. As the width of the pouches is to be changed in the direction of transport, a plurality of ramps arranged successively in the direction of transport has to be used. Prior to operation, each of the ramps is separately adjusted by hand in accordance with the degree of opening to be respectively set in the diverse process areas. Apart from the varying settings for the proper degree of opening, the ramps also have to be separately adjusted by hand when a change of format of the foil pouches requires a different width of the box. Due to the numerous actuators, adjusting the width of the box is involved with great effort. Improved processing devices for foil pouches are needed in the art.

SUMMARY

The present invention provides, in various embodiments, a processing device for foil pouches, comprising a plurality of pouch receiving elements arranged side by side, each of them being configured to receive and transport one foil pouch, as well as a plurality of pairs of oppositely disposed ramps successively arranged in the direction of transport, the pouch receiving elements being transported in a guided manner along said ramps when in operation, the distance of oppositely disposed ramps defining the width of the pouch receiving elements.

In some embodiments, the invention provides a processing device for foil pouches, comprising a plurality of pouch receiving elements arranged side by side, each configured to receive and transport one foil pouch, and a plurality of pairs of oppositely disposed ramps arranged successively in a direction of transport, the pouch receiving elements being transported in a guided manner along said ramps when the processing device is in operation, a distance d between oppositely disposed ramps defining a distance b between the pouch receiving elements, wherein the processing device comprises an adjusting element configured to automatically adjust the distance d transversely to the direction of transport.

In some embodiments, the ramps are adjustable independently of each other.

In some embodiments, the adjusting element comprises a drive for commonly adjusting multiple ramps coupled to the adjusting element.

In some embodiments, different ramps coupled to the adjusting element can be adjusted independently of one another by being individually coupled to the adjusting element.

In some embodiments, the adjusting element comprises a plurality of drives each adjusting one or more ramps and connected to a control member by which they are controlled while in operation.

In some embodiments, the adjusting element comprises an adjusting bar arranged parallel to the direction of transport and coupled to multiple successively arranged ramps by means of a plurality of actuators.

In some embodiments, the actuators are configured such that a movement of the adjusting bar parallel to the direction of transport is transmitted to a movement of the ramps transversely to the direction of transport.

In some embodiments, the adjusting bar is arranged at aside facing away from the pouch receiving elements of multiple successively arranged ramps.

In some embodiments, the adjusting bar is made of one piece or made of a plurality of bars mounted to one another.

In some embodiments, the processing device further comprises guide elements configured to guide the adjusting bar and the ramps such that the adjusting bar is only movable parallel to the direction of transport and the ramps are only movable transversely to the direction of transport.

In some embodiments, the adjusting element is configured such that positions of the ramps transversely to the direction of transport are set by adjusting a position of the adjusting bar parallel to the direction of transport.

In some embodiments, the actuators are configured such that a distance of movement of the ramps transversely to the direction of transport is restricted by transmission of the actuators.

In some embodiments, the adjusting element is configured such that different ramps are coupled to the adjusting bar by actuators of different transmissions.

In some embodiments, the adjusting element is configured such that positions of the ramps transversely to the direction of transport are individually adjusted according to the transmissions of the respective actuators.

In some embodiments, the adjusting element comprises a drive configured such that it drives the adjusting bar directly and moves the adjusting bar parallel to the direction of transport.

Additional features and advantages of the present invention are described further below. This summary section is meant merely to illustrate certain features of the invention, and is not meant to limit the scope of the invention in any way. The failure to discuss a specific feature or embodiment of the invention, or the inclusion of one or more features in this summary section, should not be construed to limit the invention as claimed.

BRIEF DESCRIPTION OF THE DRAWINGS

The foregoing summary, as well as the following detailed description of the preferred embodiments of the application, will be better understood when read in conjunction with the appended drawings. For the purposes of illustrating the systems and methods of the present application, there are shown in the drawings preferred embodiments. It should be understood, however, that the application is not limited to the precise arrangements and instrumentalities shown. In the drawings.

DETAILED DESCRIPTION

Figure 1A:
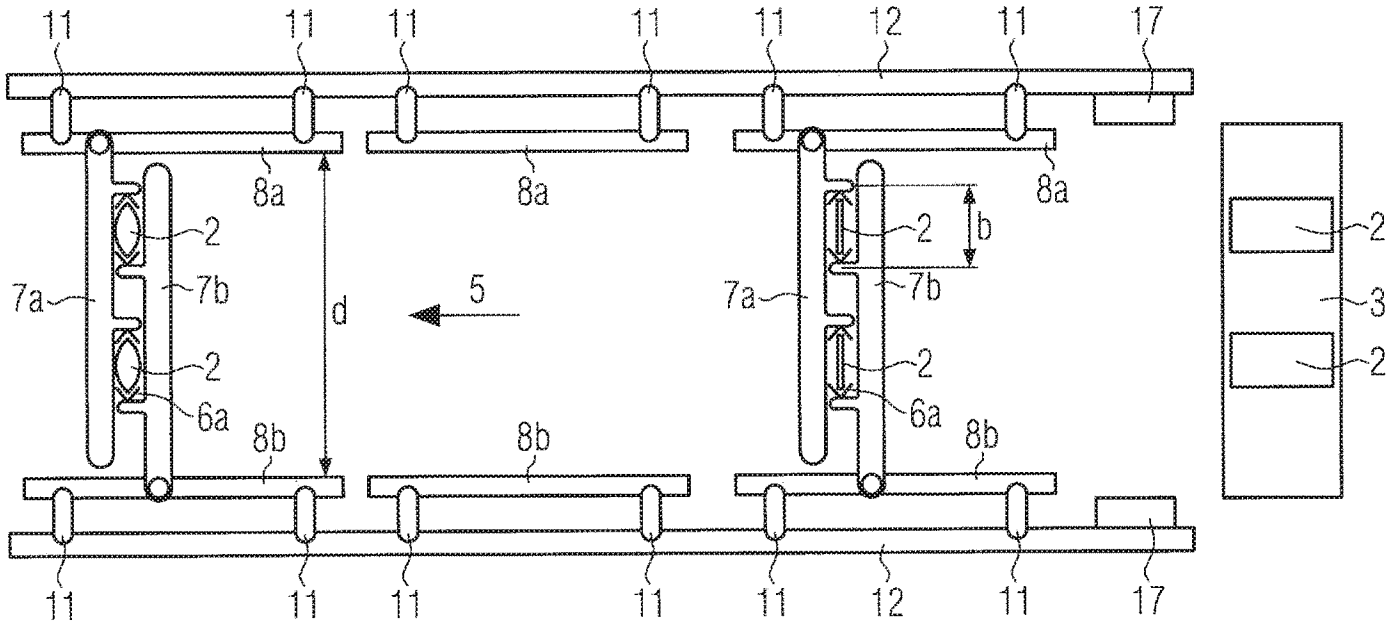
FIG. 1*a* is a schematic, not to scale plan view of a first embodiment of the processing device.

For a processing device for foil pouches or bags, for instance a filling machine, it is determined by the process that the degree of opening of the foil pouches along the transport route is changed. For instance, while being supplied to the pouch receiving element foil pouches are flat and of maximum width. However, to obtain an optimum filling, the foil pouches are expected to have the largest possible opening during the dosing process. The differences concerning the degree of opening will be adjusted by means of the ramps provided laterally. As the width of the pouches is to be changed in the direction of transport, a plurality of ramps arranged successively in the direction of transport has to be used. Prior to operation, each of the ramps is separately adjusted by hand in accordance with the degree of opening to be respectively set in the diverse process areas. Apart from the varying settings for the proper degree of opening, the ramps also have to be separately adjusted by hand when a change of format of the foil pouches requires a different width of the box. Due to the numerous actuators, adjusting the width of the box is involved with great effort.

Accordingly, it is the object of the invention to provide a processing device for foil pouches allowing for simplified adaption to the format of the foil and the degree of opening of the foil pouches.

This object is solved in that the processing device of the present invention comprises an adjusting element configured to automatically adjust the distance transversely to the direction of transport between oppositely disposed ramps.

Adjusting the distance may also imply that the ramps are positioned inclined with regard to each other. In such a case the distance transversely to the direction of transport does not change along the entire ramp.

The processing device may comprise, for example, treatment means, and foil pouches can be transported from magazines to the diverse treatment means where they may either be filled with a product or closed.

Automatic adjusting may be done, for instance by means of motors, e.g. electromotors, and, if applicable, by coupling or transmission elements and/or control elements.

Accordingly, manually adjusting the distances is no longer required, thus enabling a simplified adaptation to the format of the foil and the degree of opening of the foil pouches.

One pair of oppositely disposed ramps may particularly be configured and arranged in such a manner that both ramps are of the same length and not offset against each other along the direction of transport.

Adjusting the distance between two oppositely disposed ramps is done by adjusting the position of at least one of said two ramps. Preferably, the distance is adjusted by moving both oppositely disposed ramps in opposite directions transversely to the direction of transport. The advantage is that there is no offset transversely to the direction of transport when the distances are changed.

The ramps may be adjusted independently of each other, respectively. This means that the positions of different ramps may be set individually or that not all of the ramps have inevitably to be set in the same manner.

The ramps may either be made of one piece or of a plurality of segments connected with each other by pivot joints. The ramps or segments of ramps may either be in parallel or inclined with regard to the direction of transport.

Multiple ramps can be coupled to a common adjusting element. The adjusting element may comprise a drive for commonly adjusting a plurality of ramps coupled to the adjusting element, particularly for a plurality of successively arranged ramps arranged.

In particular, all of the ramps provided at the one side may be coupled to a first common adjusting element and all of the ramps provided at the other side may be coupled to a second common adjusting element. Both adjusting elements may either comprise a common drive or separate drives.

Ramps coupled to a common adjusting element may be adjusted independently by means of individually, particularly mechanically, being coupled to each other.

Accordingly, multiple successively arranged ramps arranged may comprise a common drive for individually setting the position of each of said ramps transversely to the direction of transport, respectively.

Accordingly, the number of the drives and of the control elements is reduced, thus enabling a simplified adaptation of the device with regard to the format of the foil and the degree of opening of the foil pouches.

Alternatively or additionally, the adjusting element may comprise a plurality of drives, each adjusting one or several ramps and each being connected to a central control element such that they are controlled thereby when in operation. This enables a particularly delicate adjustment and adaptation to the width of the box, e.g. for unusual pouch formats.

The adjusting element may comprise an adjusting bar particularly arranged parallel to the direction of transport and coupled to multiple successively arranged ramps arranged by means of a plurality of actuators. The actuators may be configured e.g. in the form of connecting links.

The actuators may particularly be configured such that a movement of the adjusting bar parallel to the direction of transport is transmitted into a movement of the ramps transversely to the direction of transport. Optionally, further degrees of freedom of the movement of the ramps and of the adjusting bar may be blocked. A ramp may be moved over its entire length by the same distance transversely to the direction of transport. It is also possible to move only a part of a ramp transversely to the direction of transport or to move different regions of the ramp by different distances. This may cause an inclination, for instance.

The adjusting bar may be arranged at the side facing away from the pouch receiving elements of multiple successively arranged ramps and parallel to said ramps. The adjusting bar may either be made of one piece or of a plurality of bars fastened to one another.

The processing device may comprise guide elements configured in such a manner and by means of which the adjusting bar and the ramps are guided such that the adjusting bar can only be moved parallel to the direction of transport and the ramps can at least, particularly only, be moved transversely to the direction of transport. Elements for supporting the ramps or the adjusting bar therewith or thereon may be used as guide elements. Alternatively or additionally, the actuators may comprise elements also serving as guide elements.

The adjusting element may be configured such that the positions of the ramps transversely to the direction of transport and their orientations may be set by adjusting the position of the adjusting bar parallel to the direction of transport.

The actuators may be configured such that the distance of the movement of the ramps transversely to the direction of transport is restricted by the transmission thereof. Hence follows that the adjustment of the position transversely to the direction of transport or a change of the orientation (e.g. inclined position) depends on the actuators used for the respective ramp or section of ramp. The actuators may be configured such that the position is adjusted either discretely or continuously.

The adjusting element may be configured such that different ramps or ramp sections are coupled to the adjusting bar by actuators with varying transmission. The adjusting element may be configured such that the positions of the ramps, particularly transversely to the direction of transport, and the orientation thereof are set according to the transmission of the respective actuators, particularly by adjusting the position of the adjusting bar.

A plurality of actuators of varying variables may act upon a ramp. In such a case the ramp is moved at various places in varying amounts transversely to the direction of transport. For instance, it can be moved from a position parallel to the direction of transport to an inclined position. In such a case the length of the ramp can be changed in the direction of movement and may preferably be compensated while being adjusted.

At least one guide element per ramp may be fixedly mounted. In case of ramps or ramp segments that are supposed to always run in parallel all acting guide elements may be configured in a stationary and non-rotating manner. In case of ramps or ramp segments that are not or not always running in parallel the guide elements affected by the above-described change of length are rotatably mounted, but cannot be displaced. Moreover, the connection of the corresponding actuators to the ramps is also rotatable. Alternatively, the guide elements may be stationary and non-rotating, and an additional guide element for connecting to the ramps may be provided.

The adjusting element may comprise a drive element configured such that it drives the adjusting bar directly and moves it parallel to the direction of transport. As mentioned above, a separate drive may alternatively or additionally be provided for one or for multiple ramps to directly drive and adjust same.

A series of pouch receiving elements may, for instance, be formed as follows. A plurality of holding elements are mounted to a first crossbar side by side, each holding element comprising a gripping element, e.g. in the form of a clamp, and a side supporting element having receiving elements, the opening of all clamps and all receiving elements leading into the same direction. The same number of holding elements as provided at the first crossbar is mounted to a second crossbar. Their receiving elements and clamps lead to a direction opposite to that one of said first crossbar. In operation, both crossbars are arranged parallel to one another and transversely to the direction of transport such that the holding elements are arranged in a comb-like manner. Accordingly, the receiving and the gripping elements thereof lead towards each other, and one holding element of the first crossbar and a holding element of the second crossbar are part of the same pouch receiving element, respectively. To each pair of holding elements a base for supporting the pouch from below may be assigned.

In operation, the first crossbar is guided along a plurality of successively arranged ramps in the direction of transport, and the second crossbar is guided, in operation, along the ramps synchronously with said first crossbar. By moving one or both ramps of a pair of first and second ramps transversely to the direction of transport such that the distance of the holding elements mounted to the corresponding crossbars changes causes a change of width of the pouch receiving elements. Thus, the pouch receiving elements can be adapted to different pouch formats, or the opening degree of the pouches can be set.

For instance, the pouch receiving elements may be configured in accordance with EP 2 113 462 A1.

Other features and advantages will be explained by means of the exemplary figures.

FIG. 1*a* shows a plan view of a first embodiment of a processing device 1 for foil pouches 2. Said foil pouches are foil pouches which are open at one side (upper side) and closed at all other sides. The side opposite to the upper side is called the bottom. While being transported, the open upper side directs upwards, the bottom directs downwards. To be noted: in its bottom region the foil pouch may be folded such that, while being unfolded, said foil pouch becomes a stand-up pouch. The foil pouches may e.g. be of rectangular shape when in flat state.

FIG. 1*a* exemplarily shows a magazine system 3 with foil pouch magazines arranged side by side in the form of magazine chambers. In operation, foil pouches are stacked into the magazine chambers from above and removed from the bottom. The step in which the foil bags are being passed on from the foil pouch magazines to the pouch receiving elements comprises that one foil pouch from each of said magazine chambers is simultaneously passed on to one of said pouch receiving elements, respectively. Such passing is done automatically, e.g. by means of a suction mechanism (not shown). However, any other kind of charging the pouch receiving elements is also conceivable. The simultaneously charged pouch receiving elements form a row of pouch receiving elements arranged side by side. The charged pouch receiving elements are moved in synchronism side by side in the direction of transport 5. This means, the row of pouch receiving elements is arranged transversely to the direction of transport. Accordingly, said pouch receiving elements may simultaneously transport foil pouches arranged side by side.

The pouch receiving elements comprise holding elements. Each holding element includes a gripping element in the form of a clamp 6*a* and a side supporting element (not shown). Said element may include a receiving element which may be, for instance, a slip-shaped guide element which is open towards the top, the bottom and towards the foil pouches. As shown here, the guide element may comprise slanted walls or, alternatively, parallel walls. In operation, the foil bags are inserted into the guide elements from the top and will thus be supported therein from the sides. By means of said receiving elements, a lateral movement of the foil bags or pouches and, in this example, also a movement in or against the direction of transport is restricted. In this case, the pouches are, for instance, supported from below by a bottom of the receiving element but may alternatively also be supported by vertically adjustable supporting elements. The clamps grasp the foil pouches at the lateral upper ends thereof and can hold them and e.g. also close them while being transported in a suspended manner.

The distances of the holding elements are variable and are adjusted in accordance with the width b of each of said processed foil pouches. While being delivered from the foil pouch magazines, the foil pouches are flat and, thus, of maximum width. At this time, the holding elements are arranged at a distance b approximately corresponding to the maximum width, preferably at a distance which is slightly broader than said maximum width so that the foil pouches can be inserted into the pouch receiving elements without any problems and can be supported laterally therein in a safe manner. The distance between the holding elements in transit may optionally be reduced. As a consequence, the foil pouches can be opened at the upper side thereof, e.g. in order to pour in a liquid.

A plurality of holding elements with their receiving elements and clamps facing into the same direction are mounted side by side at a first crossbar 7*a*. The same number of holding elements mounted to the first crossbar is mounted to a second crossbar 7*b*. The receiving elements and the clamps thereof, however, face into the opposite direction. In operation, the crossbars are arranged parallel to each other and transversely to the direction of transport such that the holding elements are arranged like a comb. This means that the receiving elements and the clamps thereof are face each other and that one holding element of said first crossbar and one holding element of said second crossbar belong to the same pouch receiving element, respectively.

FIG. 1*a* shows a plurality of first and second crossbars. In operation, one or more of said first crossbars are guided along a plurality of successively arranged ramps 8*a* which are arranged, according to this example, parallel to the direction of transport. In operation, the second crossbars are guided along oppositely disposed ramps 8*b* in synchronism with said first crossbars. In FIG. 1*a*, a plurality of pairs of first ramps and of second ramps are shown which are successively arranged in the direction of transport. Oppositely disposed ramps are spaced from one another at a distance d. To be noted: the ramps may also be arranged in an inclined manner with respect to each other and/or the direction of transport. The ramps are each movably arranged transversely to the direction of transport. While guiding the crossbars by means of the ramps the coupling is such that the crossbars, and analogously, the holding elements are moved transversely to the direction of transport when the ramp is moved transversely to the direction of transport. Moving one or both ramps of a pair of first and second ramps transversely to the direction of transport such that the distance between the holding elements mounted to the corresponding crossbars changes causes a change of width of the pouch receiving elements. Thus, the pouch receiving elements can be adapted to different pouch formats, or the degree of opening of the pouches can be set. Preferably, both of the oppositely disposed ramps are adjusted by the same distance in opposite direction. This prevents misalignment of the transport routes transversely to the direction of transport.

The processing device comprises two adjusting elements configured such that the positions of different ramps can simultaneously and at the same time individually or independently of one another be adjusted, respectively.

In this example, the adjusting elements each include a plurality of actuators 11 and an adjusting bar 12, the actuators each coupling one ramp and the adjusting bar. The adjusting bar of this example is arranged at the side of multiple successively arranged ramps and facing away from the crossbars or the pouch receiving elements, but may also be provided at a different location. Furthermore, the adjusting bar is arranged parallel to the direction of transport but may alternatively be oriented differently as long as suitable transmission elements are being used. According to this example, adjusting bars are assigned to both said first as well as said second ramps. However, this does not have to be the case since for adjusting the width of the pouch receiving elements it suffices to move the ramps of one side of the transport route either towards each other or away from each other, particularly transversely to the direction of transport. The adjusting bar may either be made of one piece or of a plurality of bars fixed to one another.

The successively arranged ramps are coupled to the adjusting bar by means of the actuators. The actuators are configured such that a movement of the adjusting bar parallel to the direction of transport is transmitted into a movement of the ramp transversely to the direction of transport. To be noted: the ramps may become inclined when actuators of different transmissions act along one ramp.

It depends on the actuators used how far the ramps are moved transversely to the direction of transport (and/or, if applicable, are being inclined). When the degree of opening in the direction of transport is expected to increase actuators of different transmissions may be used for successively arranged ramps. Thus, the positions of the ramps can be set independently of one another according to the respective actuators by adjusting the position of the adjusting bar. The actuators may be configured, for instance, in the form of connecting links.

Figure 1B:
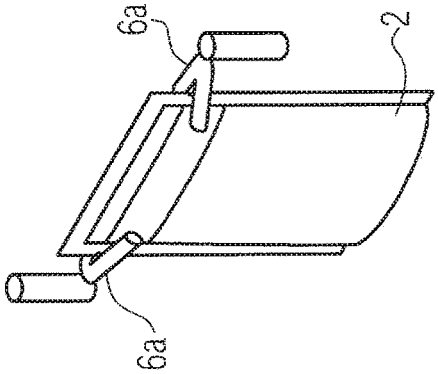
FIG. 1*b* is a schematic, not to scale oblique view of a partly open pouch.
Figure 1C:
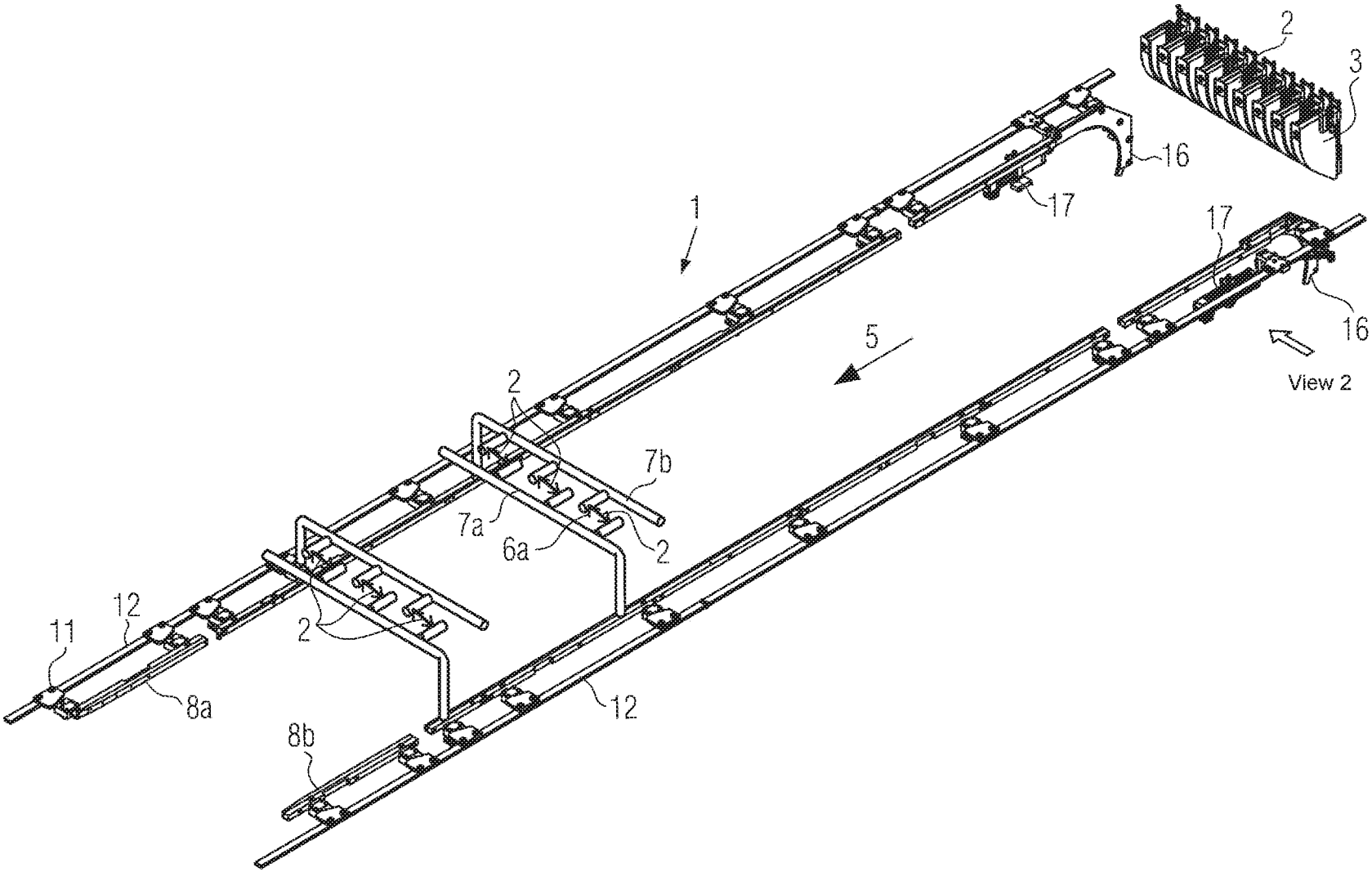
FIG. 1*c* is a schematic, not to scale oblique view of the first embodiment of the processing device.

FIG. 1*b* shows an open foil pouch, here in the form of a stand-up pouch, with an opening being formed on top and a bottom being folded up when being pushed together at the sides. FIG. 1*c* shows an oblique view of the first embodiment.

Figure 2:
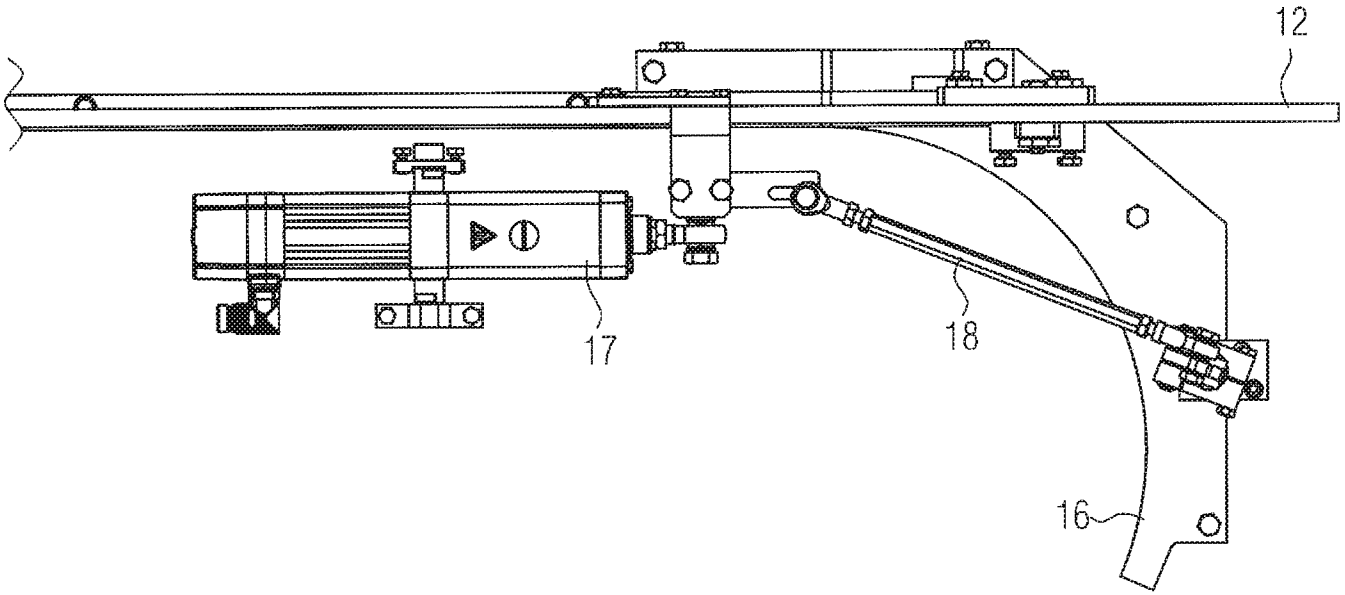
FIG. 2 is a schematic, not to scale side view of a section of the first embodiment of the processing device.
Figure 3:
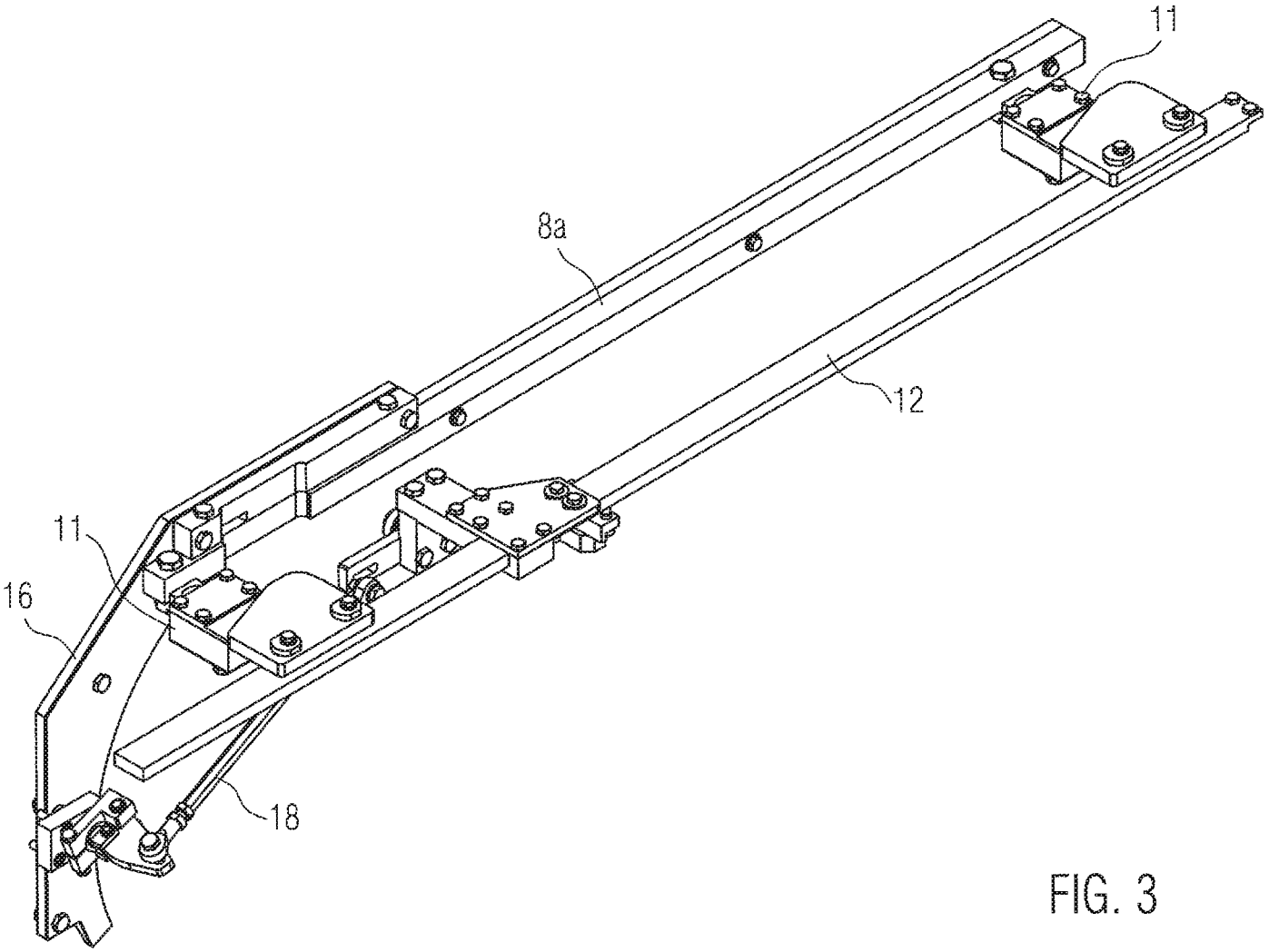
FIG. 3 is a schematic, not to scale oblique view of a section of the first embodiment.

FIG. 2 shows a side view of the region indicated in FIG. 1*c*, with an adjusting bar 12, a ramp with a flat end piece 16, a drive 17, a transmission mechanism 18 being shown in detail. An oblique view of said region is shown in FIG. 3. The drive which is fixedly arranged in this example, e.g. at a frame, drives the adjusting bar and moves it parallel to the direction of transport. By means of a transmission mechanism 18, e.g. a gear, the movement of the drive is additionally transmitted into a movement of the ramp so that the ramp is moved transversely to the direction of transport when the drive is actuated. The transmission mechanism acts upon the flat end piece 16 of the ramp. Accordingly, the transmission of the movement of the adjusting bar in this region is not only done via the actuators but additionally via the transmission mechanism 18. Thus, the end piece of the ramp is stabilized. Such a design is advantageous, since the degree of opening has, thus, been defined up to the position where the pouches are being delivered which is done at the peak of deviation.

Figure 4:
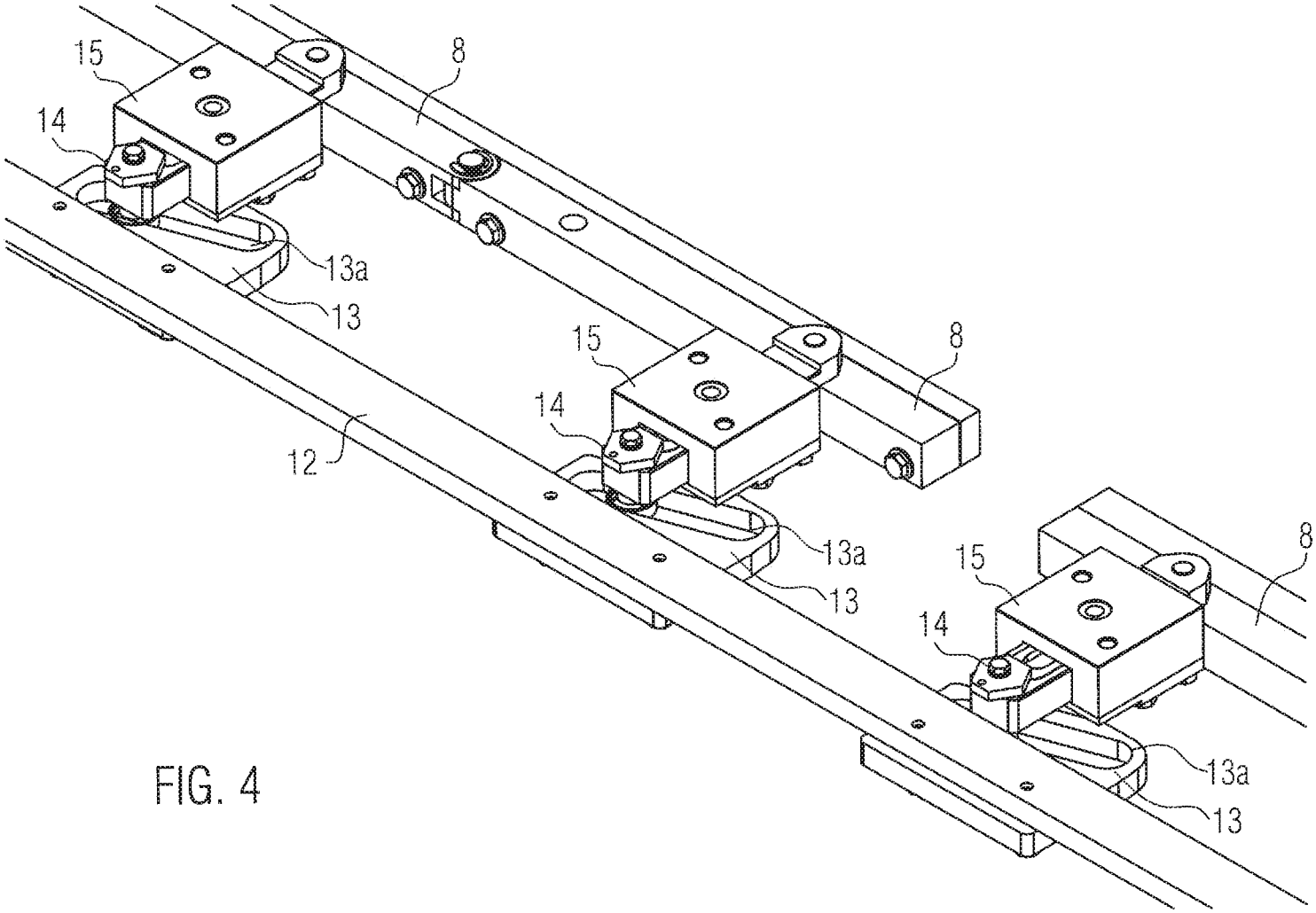
FIG. 4 is a schematic, not to scale oblique view onto a plurality of ramps and the respective actuator according to the first embodiment.

FIG. 4 is a detailed view of two ramps, an adjusting bar and several actuators that may be used for the above-referenced embodiment. The actuators will be described below in detail. It is a matter of course that a different actuator may also be used for the above embodiment.

As can be seen here, an element 13 having a longitudinal opening 13*a* is fixed in position at the adjusting bar. In operation, the opening is positioned at the upper side of the element and is obliquely arranged with respect to the direction of transport. In other words: it has an inclined orientation in terms of the direction of transport. For instance, it may be inclined by 1° to 60°, particularly 5° to 45°, especially 10° to 30°. At a first end, a connecting element 14 is fixed in position and pivotally mounted to a ramp. The other (second) end is supported in the opening in such a manner, here suspended from above, that it can be displaced in said opening. The form of the opening and of the second end is selected such that a rotation of the second end in the opening is blocked. The connecting element is supported in a guide element 15 fixed in position so as to block a movement of the connecting element and, thus, also of the ramp in vertical direction and parallel to the direction of transport. The adjusting bar is supported such that a vertical movement and a movement transversely to the direction of transport are blocked. Hence follows that the adjusting bar is only movable parallel to the direction of transport, and the ramp is only movable transversely to the direction of transport. To be noted: the ramp cannot only be displaced but also be inclined, as explained above. The transmission of the actuator is defined by the length and the inclination of the opening.

Long ramps are preferably provided with a plurality of such actuators, otherwise the ramp may tilt in the direction of transport in an uncontrolled manner.

Needless to say that, alternatively to the above-described coupling, element 13 including the longitudinal opening may also be mounted to the ramp and the connecting element may also be mounted to the adjusting bar. Besides, not only an element with an opening but also a different element may be used to transmit the movement.

The functional principle of a ramp adjustment by means of an above-described device is as follows: when the adjusting bar is moved via the drive element along the direction of transport it takes along the element 13 including longitudinal opening 13*a*. As the connecting element is supported in said opening, it is forced to move. Owing to the orientation of the opening inclined towards the direction of transport and to the fact that the connecting element cannot be moved in the direction parallel to the direction of transport, as it is locked in this direction by the guide element, it is moved in this example transversely to the direction of transport. In doing so, it is guided by means of the guide element. Due to the firm connection with the ramp, the ramp is taken along via the connecting element.

Owing to the above-described embodiment, a plurality of successively arranged ramps may be adjusted together by just one drive element and proper transmission elements by means of exactly one drive element but, yet, independently of each other.

To be noted: in cases where a ramp is envisaged to be inclined, different actuators are preferably arranged along said ramp, of which at least one is arranged in a fixed position and cannot rotate and others of them are arranged in a fixed position and can be rotated and are mounted to said ramp in a rotating manner.

Figure 5:
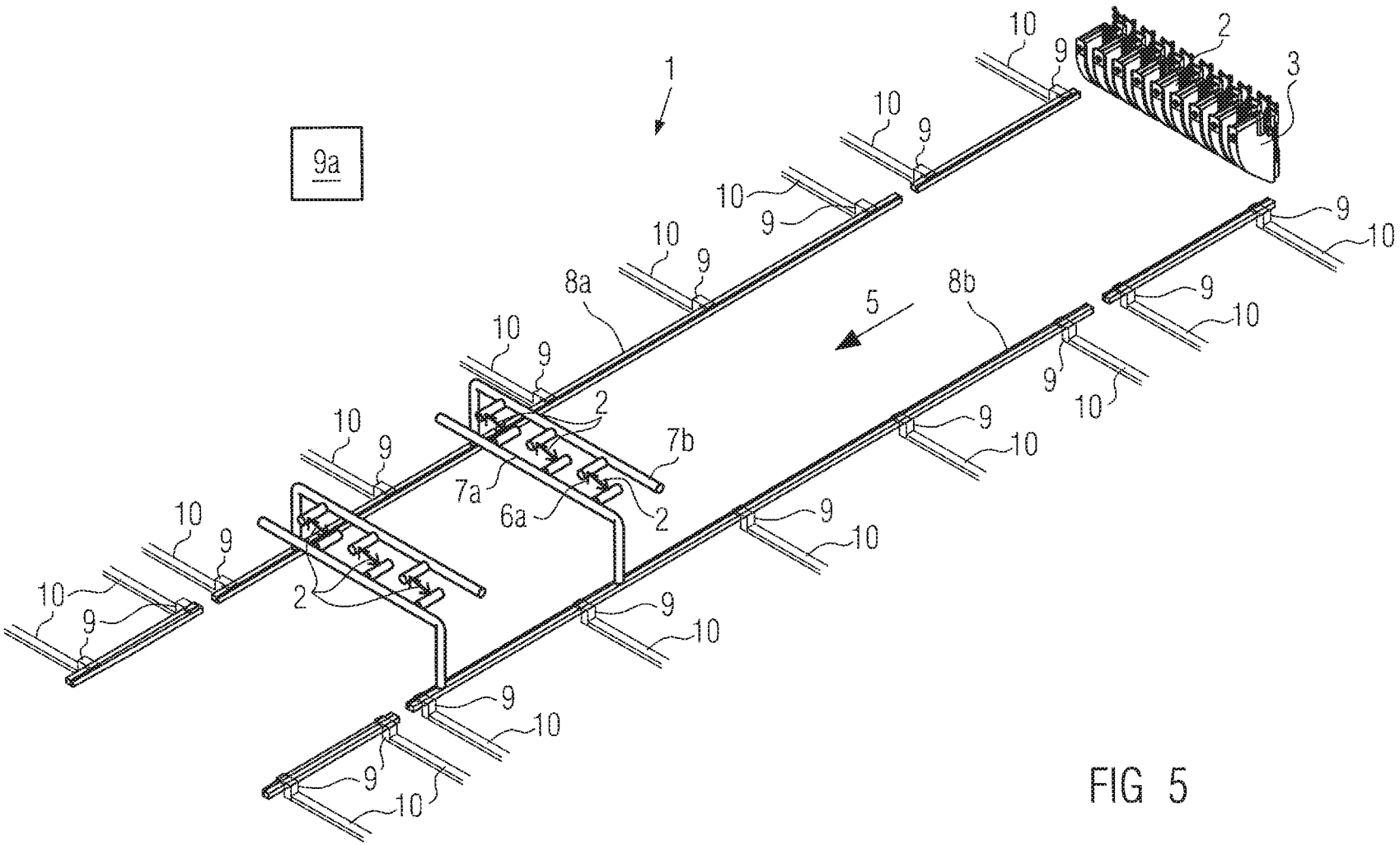
FIG. 5 is a schematic, not to scale oblique view of a second embodiment of the processing device.

FIG. 5 shows another embodiment of a processing device for foil pouches. In principle, the device is configured as the device according to FIG. 1*c*. However, separate actuators 9 are assigned to the ramps. According to this example, each ramp is moved along a bar 10 or a rail by means of a separate actuator. In this example, the actuators are connected to a common control member 9*a* for actuating the actuators.

According to the above-described embodiments, preferably one or several frames are provided which are not shown just for reasons of clarity. The guide elements 15 and/or the drive element 17 are mounted to said frame or said frames which serve to support the ramps and the adjusting bars.

Needless to say that the features according to the above-described embodiments are not restricted to said special combination and may also be used in any other combination.

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. For example, any feature(s) in one or more embodiments may be applicable and combined with one or more other embodiments. Hence, it is not desired to limit the invention to the exact construction and operation shown and described and, accordingly, all suitable modification equivalents may be resorted to falling within the scope of the invention as claimed. It is the intention, therefore, to be limited only as indicated by the scope of the claims appended hereto.

What is claimed is:

1. A processing device for foil pouches, comprising:

a plurality of pouch receiving elements arranged side by side transversely to a direction of transport, each configured to receive and transport one foil pouch, and a plurality of pairs of oppositely disposed ramps arranged successively in the direction of transport, wherein the ramps are adjustable independently of each other, the pouch receiving elements being transported in a guided manner along said ramps when the processing device is in operation, wherein width b, transverse to the direction of transport of the pouch receiving elements is correlated with a distance d, transverse to the direction of transport, between the oppositely disposed ramps, such that the distance d of the oppositely disposed ramps defines the width b of the pouch receiving elements, and wherein the processing device comprises an adjusting element configured to automatically adjust the distance d transversely to the direction of transport.

2. The processing device for foil pouches as set forth in claim 1, wherein the adjusting element comprises a drive for commonly adjusting multiple ramps of the plurality of pairs of oppositely disposed ramps coupled to the adjusting element.

3. The processing device for foil pouches as set forth in claim 2, wherein different ramps of the multiple ramps of the plurality of pairs of oppositely disposed ramps coupled to the adjusting element can be adjusted independently of one another by being individually coupled to the adjusting element.

4. The processing device for foil pouches as set forth in claim 1, wherein the adjusting element comprises a plurality of drives each adjusting one or more ramps of the plurality of pairs of oppositely disposed ramps and connected to a control member, by which they are controlled while in operation.

5. The processing device as set forth in claim 1, wherein the adjusting element comprises an adjusting bar arranged parallel to the direction of transport and coupled to multiple successively arranged ramps of the plurality of pairs of oppositely disposed ramps by means of a plurality of actuators.

6. The processing device as set forth in claim 5, wherein the actuators are configured such that a movement of the adjusting bar parallel to the direction of transport is transmitted to a movement of the multiple successively arranged ramps of the plurality of pairs of oppositely disposed ramps transversely to the direction of transport.

7. The processing device as set forth in claim 5, wherein the adjusting bar is arranged at a side facing away from the pouch receiving elements of the multiple successively arranged ramps of the plurality of pairs of oppositely disposed ramps.

8. The processing device as set forth in claim 5, wherein the adjusting bar is made of one piece or made of a plurality of bars mounted to one another.

9. The processing device as set forth in claim 5, further comprising guide elements configured to guide the adjusting bar and the multiple successively arranged ramps of the plurality of pairs of oppositely disposed ramps such that the adjusting bar is only movable parallel to the direction of transport and the multiple successively arranged ramps of the plurality of pairs of oppositely disposed ramps are at least movable transversely to the direction of transport.

10. The processing device as set forth in claim 5, wherein the adjusting element is configured such that positions of the multiple successively arranged ramps of the plurality of pairs of oppositely disposed ramps transversely to the direction of transport are set by adjusting a position of the adjusting bar parallel to the direction of transport.

11. The processing device as set forth in claim 5, wherein the actuators are configured such that a distance of movement of the multiple successively arranged ramps of the plurality of pairs of oppositely disposed ramps transversely to the direction of transport is restricted by transmission of the actuators.

12. The processing device as set forth in claim 5, wherein the plurality of actuators comprises actuators having different transmissions, wherein different ones of the multiple successively arranged ramps of the plurality of pairs of oppositely disposed ramps are coupled to the adjusting bar by actuators of different transmissions among the actuators having different transmissions.

13. The processing device as set forth in claim 12, wherein the adjusting element is configured such that positions of the multiple successively arranged ramps of the plurality of pairs of oppositely disposed ramps transversely to the direction of transport are individually adjusted according to the transmissions of the respective actuators.

14. The processing device as set forth in claim 5, wherein the adjusting element comprises a drive configured such that it drives the adjusting bar directly and moves the adjusting bar parallel to the direction of transport.

* * * * *